United States Patent [19]

Combes

[11] Patent Number: 5,015,122

[45] Date of Patent: May 14, 1991

[54] SYSTEM PERMITTING CHANNELING OF DRAINAGE FLUID

[76] Inventor: Denis Combes, 153, avenue Albert Thomas, 81000 Albi, France

[21] Appl. No.: 377,407

[22] Filed: Jul. 10, 1989

[51] Int. Cl.[5] ..... E02B 3/00; B65G 11/00

[52] U.S. Cl. ..... 405/36; 193/2 R; 193/2 A; 193/25 A; 193/25 E

[58] Field of Search ..... 405/36, 38, 39, 41, 405/43; 193/2 R, 2 A, 25 R, 25 A, 25 E

[56] References Cited

U.S. PATENT DOCUMENTS

| | | | |
|---|---|---|---|
| 1,344,656 | 6/1920 | Saltsman . | |
| 2,705,144 | 3/1955 | Ridgway | 193/2 R X |
| 2,772,764 | 12/1956 | McClellan | 193/25 E X |
| 3,386,252 | 6/1968 | Nelson . | |
| 3,410,094 | 11/1968 | Shelley | 405/39 |
| 4,561,801 | 12/1985 | Nantz | 405/15 |

FOREIGN PATENT DOCUMENTS

| | | | |
|---|---|---|---|
| 224566 | 11/1962 | Austria | 405/43 |
| 212909 | 3/1987 | European Pat. Off. | 193/2 A |
| 2203159 | 8/1973 | Fed. Rep. of Germany . | |
| 3632763 | 3/1988 | Fed. Rep. of Germany | 193/25 E |
| 2125826 | 9/1972 | France . | |
| 2528885 | 12/1983 | France . | |
| 2569214 | 2/1986 | France . | |
| 894052 | 12/1981 | U.S.S.R. | 405/39 |
| 2093880 | 9/1982 | United Kingdom . | |
| 2106968 | 4/1983 | United Kingdom . | |

*Primary Examiner*—Dennis L. Taylor
*Assistant Examiner*—John Ricci
*Attorney, Agent, or Firm*—Spencer & Frank

[57] ABSTRACT

A system for channeling drainage fluid from a point located upstream to a point downstream comprises a series of conduit elements linked together and partially fitted in one another. This system is remarkable in that the series of conduit elements is assembled so that the linked conduit elements can articulate with one another and each conduit element is suspended from the previous conduit element of the series with upper end of the first conduit element being suspended from a point of anchorage located upstream. The conduit elements articulate with one another in pairs by means of a disconnectable hook arrangement, such as performed protuberances, which acts as a hinge. The above system for channeling running water prevents the degradation of slopes served by such systems.

11 Claims, 6 Drawing Sheets

SYSTEM PERMITTING CHANNELING OF DRAINAGE FLUID

BACKGROUND OF THE INVENTION

The present invention relates to a system that permits channeling of freely flowing fluid, such as water from rain collector outlets, along a hillside whose grade or poor accessibility renders traditional solutions too costly.

If the topography of a terrain is suitable (insignificant slope, access to the foot of the slope, etc.), prior art channels are available which generally comprise a semi-circular channel laid in a bed of concrete.

If the grade of the incline is too abrupt, the above solution is no longer applicable and it is necessary to resort to civil engineering projects such as reinforced concrete slideways, openings in chutes, etc.. Such works are difficult to realize and take long to complete, resulting in very high costs.

Numerous solutions have already been conceived which lessen the problems mentioned above. One of these solutions is seen in a series of conduit elements which, partially fitted into one another, form a groove allowing the water to collect and to be channeled without risking erosion of the terrain.

Such conduit elements are inexpensive and light-weight, permitting installation in inaccessible locations and involve few means. However, to serve as a channel supported on a slope, it is necessary that conduit elements of such a system remain attached to one another and adhere to the different grades of the terrain.

To this effect, the conduit element proposed in British Patent No. 2,106,968 has preformed horizontal latticed edges which, once the conduit elements are placed on the terrain, permit vegetation to get entangled in the mesh of the lattice work, assuring, in this manner, retention of each conduit element in the ground.

A second solution for a conduit element is proposed in French Patent No. 2,569,214. To this effect, the two edges of a profiled element in the form of a gutter are provided with fasteners which are perpendicular in relation to the plane of the element and are for anchorage in the soil.

Whatever may be the realized form of a conduit element for a system permitting channeling of drainage fluid, the two preceding solutions proposed for holding the elements in position with respect to one another are based on their anchorage with respect to the support.

Using these facts as a starting point, the applicant has conceived another form for realizing a system for channeling drainage which does not require the individual anchoring of the above-mentioned conduit elements to the ground and thus provides greater flexibility for installation of such system.

SUMMARY OF THE INVENTION

According to the invention, the conduit elements of a system permitting the channeling of drainage water are mounted so as to be linked to one another and are suspended, by means of the upper end of the first conduit element, from a point of anchorage located upstream. Thus, assembly of such system involving conduit elements which are linked to one another, starts at the top of the slope so as to keep to a minimum interventions on the level of the slope itself. The free angular expansion of the conduit elements into each other due to their articulation allows the mentioned system to conform readily to the different changes in grade, either negative or positive. Moreover, only one point of anchorage suffices, namely, the one of the first conduit element located upstream, in order for all the elements to be held together, each one being suspended from the preceding one. In addition, the partial fitting of the afore-mentioned conduit elements, one on top of the other, limits their freedom of angular expansion which permits their articulation in such a way that the channel, which is delimited by all the conduit elements suspended from one point of anchorage upstream, forms a harmonious curve that responds to major changes in grade of the terrain. In effect, since no conduit element is fixed to the ground, the series of suspended elements is not forced to adapt itself perfectly to all the irregularities of the terrain.

According to one particularly advantageous characteristic of the invention, the afore-mentioned elements are joined to each other in pairs by means of a detachable hook which serves as a hinge. Consequently, the conduit elements may be disconnected from one another for facilitating transport, and the length of the system created by a sequence of conduit elements may be adopted for a planned use. This hook device may either be designed as one unit or be independent (by means of a system of preformed hooks) of the afore-mentioned conduit elements.

According to a first embodiment of the invention, the afore-mentioned conduit elements are obtained by molding a cement concrete, or a resin concrete, a cement reinforced with glass fibers, composite materials, etc.. In this case, the hook device serving as a hinge is realized by protuberances (5', 6') which are formed by being molded to the upper and lower parts of the mentioned conduit element (See FIGS. *7a* and *7b*)in order to cooperate with protuberances above and below the two contiguous conduit elements. These protuberances, serving as hinges, are formed according to a prior art method in order to hold the afore-mentioned elements while permitting angular expansion between the latter.

According to another embodiment of the invention, the afore-mentioned conduit elements are shaped of a preformed sheet of material, preferably of metal. By serving as hinges, these conduit elements permit the adaptation of hooks and rings as anchoring device for connecting the elements to each other.

The fundamental concept of the invention having been elucidated above, other characteristics and other advantages of the present invention will become clearer upon reading the specification which follows giving, by way of a non-limiting example and with respect to the attached drawings, a method for manufacturing a channel system which conforms to the invention.

DESCRIPTION OF THE PREFERRED EMBODIMENT

Figure 1:
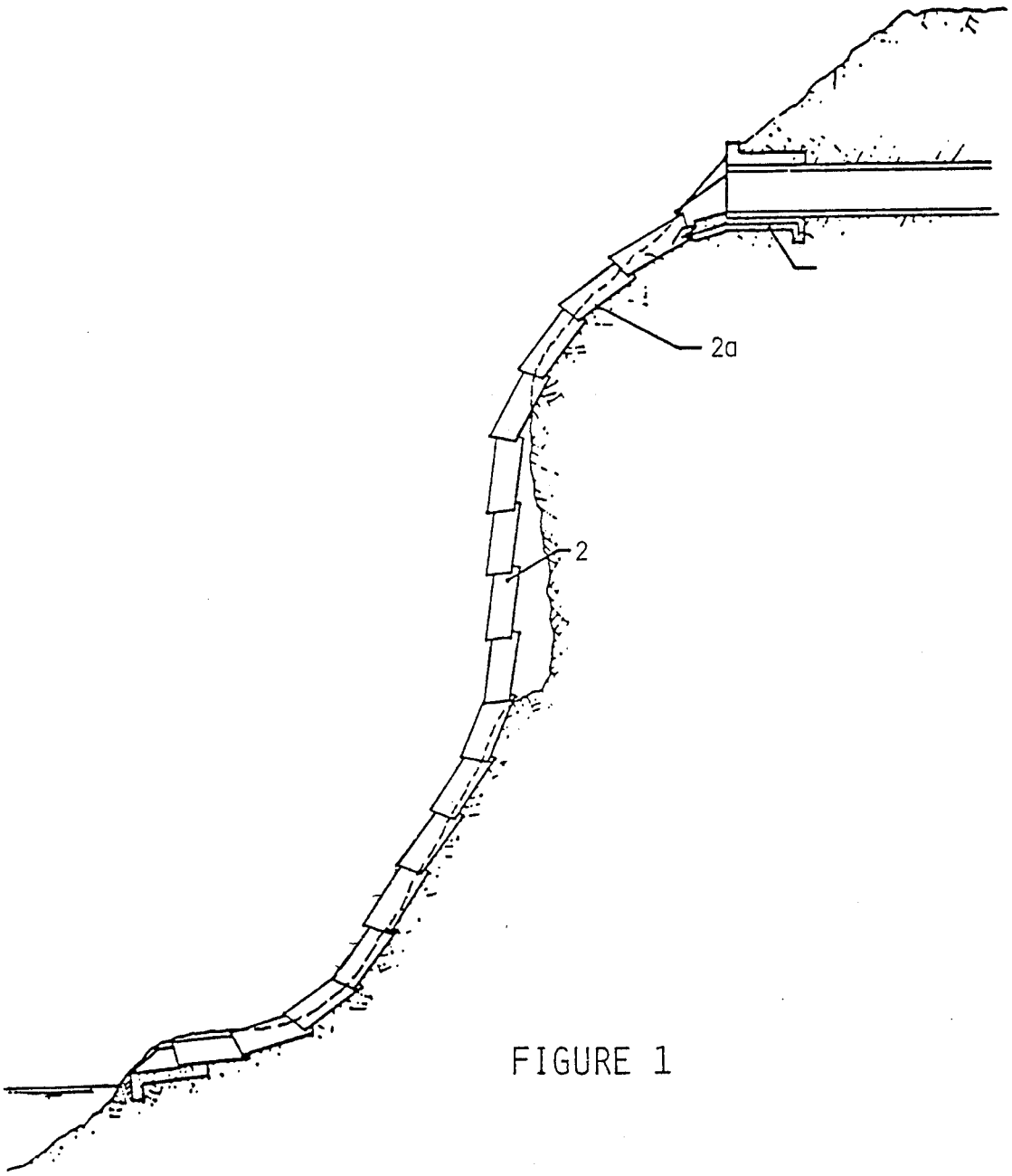
FIG. 1 is a side view of a channel system according to the invention.
Figure 2:
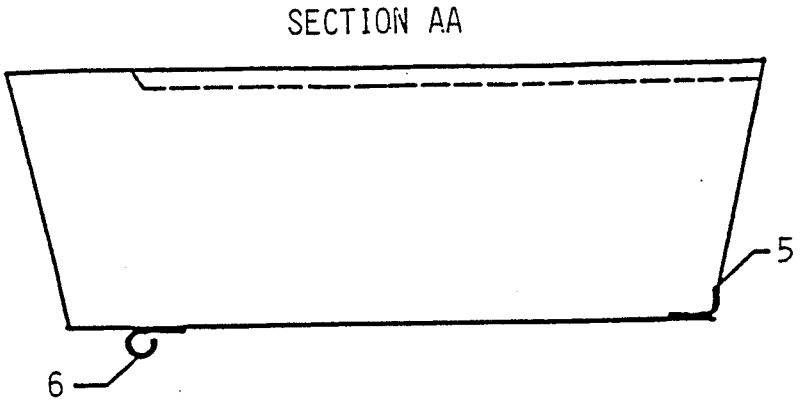
FIG. 2 is a side elevational view of a conduit element of the system shown in FIG. 1.
Figure 4:
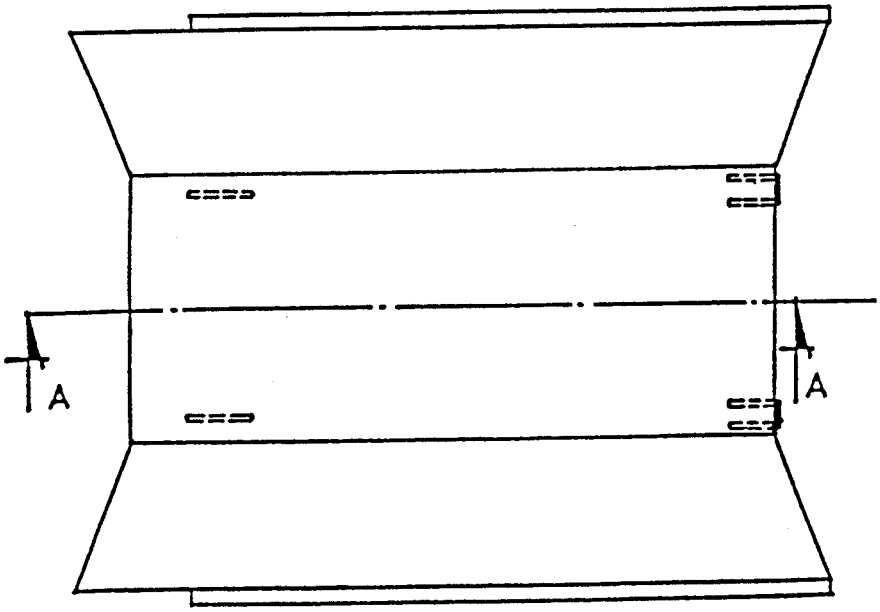
FIG. 4 is a plan view of such conduit element.
Figure 3:
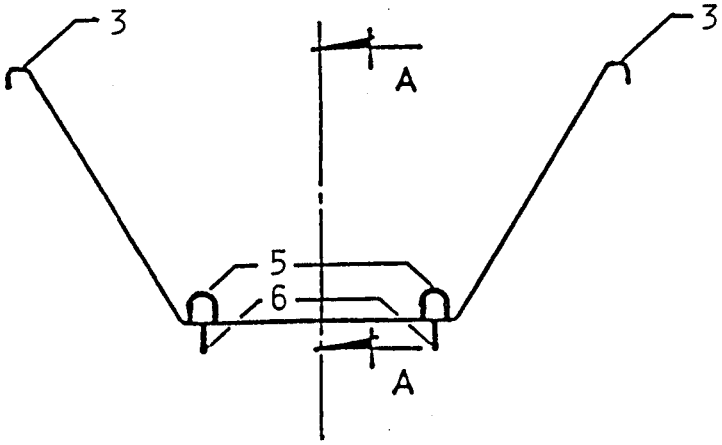
FIG. 3 is a frontal view of such conduit element.
Figure 5:
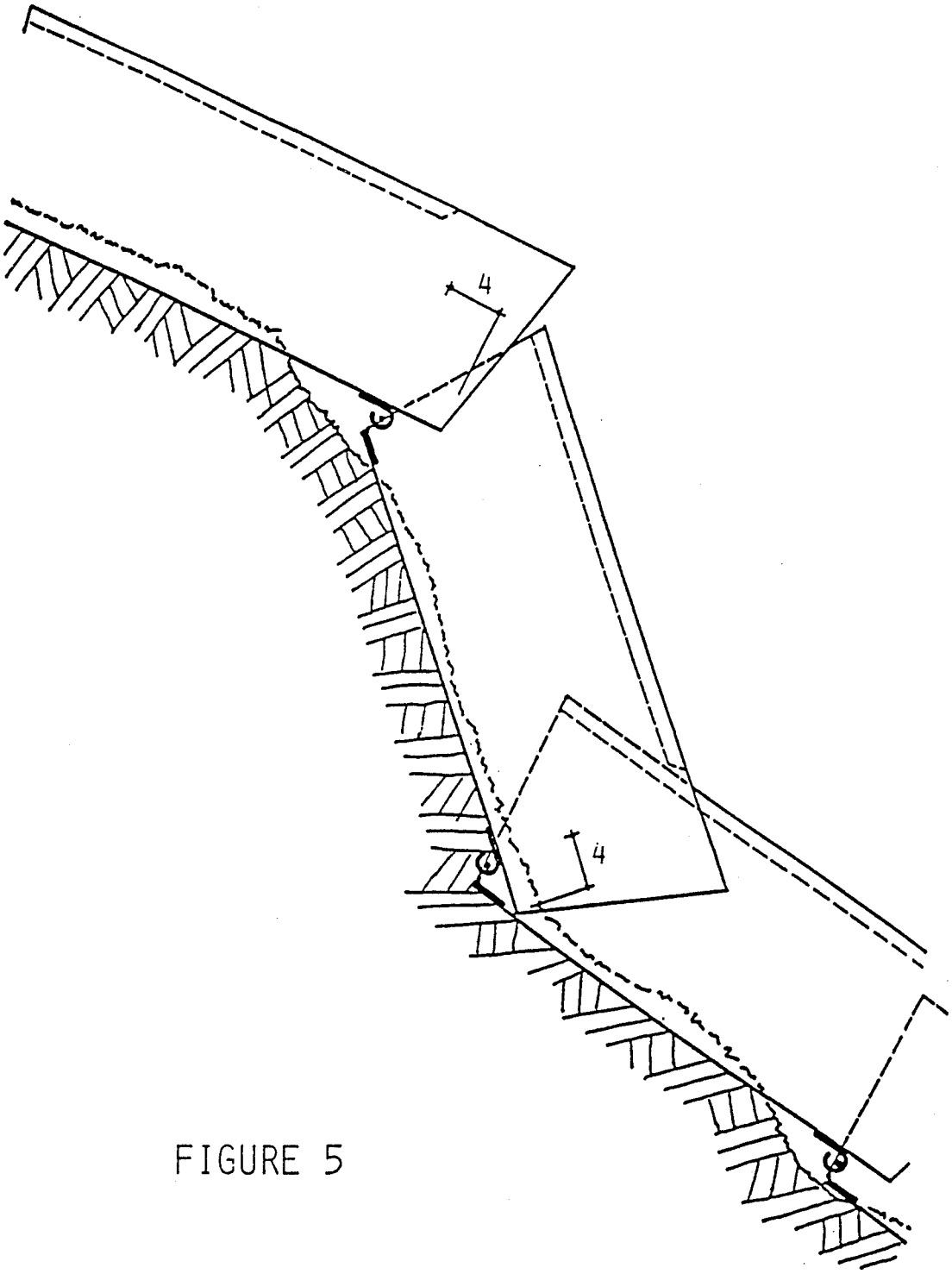
FIG. 5 is a sectional, view of three conduit elements of a channel system according to the invention.
Figure 6:
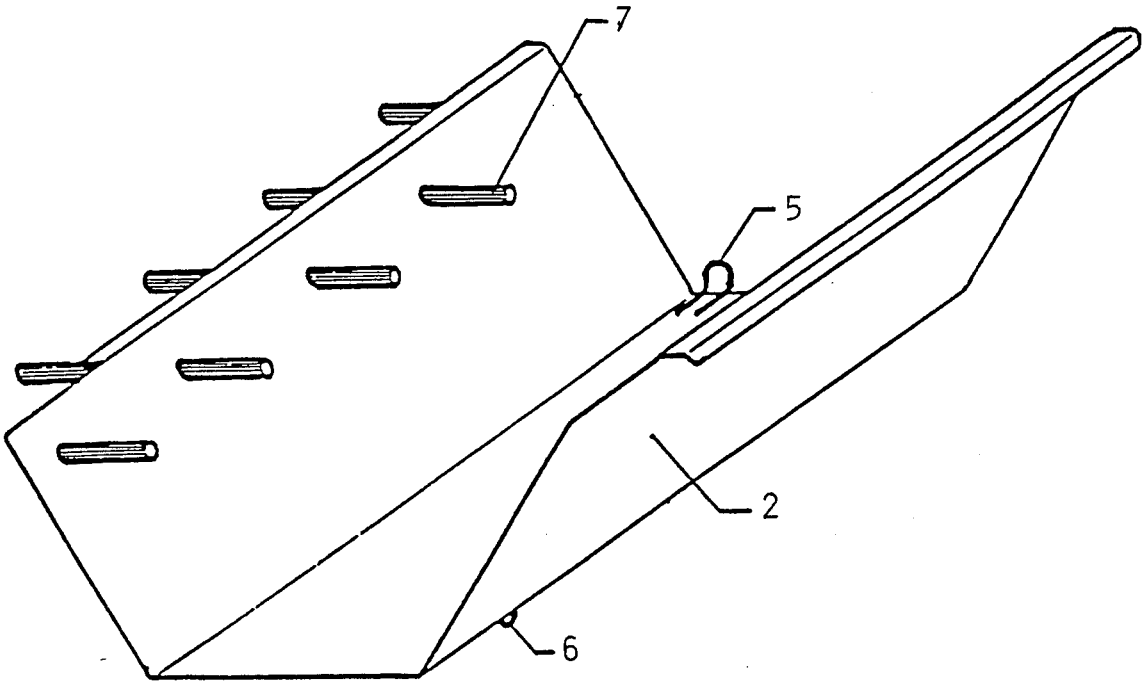
FIG. 6 is a perspective view of a conduit element according to the invention, adapted for a specific use.
Figure 7A:
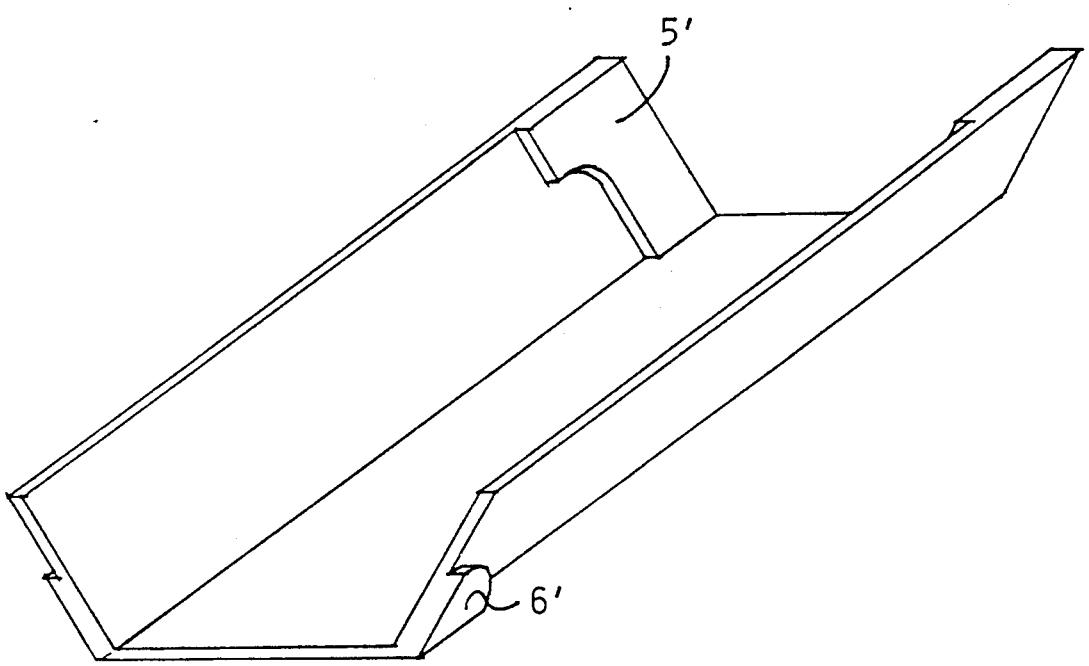
FIGS. 7*a* and 7*b* illustrate exemplary conduit elements according to the invention and their respective hook devices formed of unitary construction.
Figure 7B:
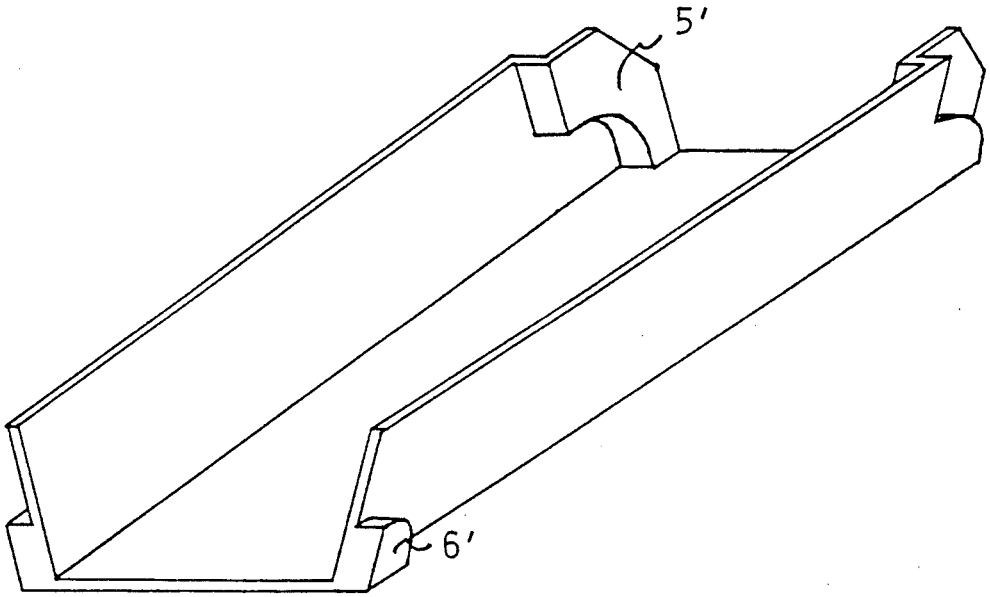

As shown in the drawing of FIG. 1, the system of the invention for channeling drainage water begins with an anchorage block 1 located upstream from the end of the system where the drainage water drains and comprises a sequence of conduit elements 2 partially fitted into one another and suspended from the upper end of the first element 2*a* attached to the anchorage block 1. As may be seen in the drawing of FIGS. 2, 3, 4 and 5, these conduit elements 2 have the shape of a trough made of a preformed sheet material. The conduit elements may be shaped to form a trapezoidal cross section when an imaginary horizontal line is drawn parallel to the bottom portion which connects the longitudinal sides of the conduit element. The longitudinal sides of the conduit elements being open at their two ends, act as longitudinal reinforcing ribs 3.

For the principal application of the invention, the afore-mentioned conduit elements 2 are assembled, linked to each other in such a way that all of the afore-mentioned conduit elements 2 of the system together, suspended from the anchorage block 1, adapt only to the different changes in the grade of the afore-mentioned slope (see FIG. 1).

In order to ensure sufficient tightness between two consecutive conduit elements 2, the overlapping distance 4 (see FIG. 5) between two elements will be adapted for limiting angular expansion between them, taking into consideration the speed of the drainage water, its discharge and the grade of the slope. Of course, the degree of tightness required is that which is adequate for collecting and channeling water along the slope.

Advantageously, the conduit elements 2 are linked to one another by means of a disconnectable hook device 5–6 that performs the role of a hinge. This disconnectable hook device comprises two rings 5 located at the upper end of each conduit element 2 on one side and two hooks 6 located at the lower end of the same conduit element on the other side. Thus, as one may see on the drawing in FIG. 5, the rings 5 of one conduit element are intended to engage the hooks 6 of the conduit element 2 located upstream and the hooks 6 located at the lower part of this conduit element 2 are intended to be introduced into the interior of the ring 5 of the next conduit element 2 located downstream. This disconnectable interlocking hook 5–6 allows easier handling during transport by permitting the stacking of the conduit elements 2.

According to a preferred embodiment of the invention, rungs 7 are mounted along the conduit elements 2 to permit movement and/or the descent of maintenance personnel on the system according to the invention.

The conduit elements 2 of the present invention permit the installation of a system intended for channeling running water in order to prevent degradation of the slopes serviced by such a system.

It is understood that the system was described and represented with the intention of making a disclosure rather than a limitation. Of course, various simplifications, modifications and improvements may be made to the above example without departing from the scope of the invention taken in its broadest aspects and concept.

In order to ensure the best understanding of the drawings, a list of references numerals and their legend is listed below:

1. . . . anchorage block
2. . . conduit element
3. . . reinforcing ribs
4. . . distance of overlap between two conduit elements 2
5. . . ring
6. . . hook
7. . . rungs

I claim:

1. System permitting the channeling of drainage fluid from a point located upstream to a point downstream, comprising:

a series of fitted conduit elements assembled together to articulate with one another, each conduit element of the assembled series being suspended from the preceding conduit element in the series where the first conduit element in the series is suspended from a point of anchorage located upstream; and disconnectable hooking means for hingedly connecting adjacent conduit elements, wherein the disconnectable hooking means of each conduit element comprises at its upper portion on one side at least one ring and at its lower portion on the other side at least one hook, said at least one ring of a conduit element being intended to engage said at least one hook of an adjacent conduit element in order to form a hook arrangement which serves as a hinge.

2. System according to claim 1, wherein said disconnectable hooking means are formed independent of sid conduit elements.

3. System according to claim 1, wherein said conduit elements are formed from a preformed sheet material.

4. System according to claim 1, wherein each conduit element is in the shape of an open trough having a bottom portion and two longitudinal sides extending upwardly and outwardly, from the bottom portion, said at lest one ring of a conduit element being disposed on one surface and end of its bottom portion and said at least one hook of a conduit element being disposed on the other surface and end of its bottom portion.

5. System permitting the channeling of drainage fluid from a point located upstream to a point downstream, comprising:

a series of fitted conduit elements assembled together to articulate with one another, each conduit element of the assembled series being suspended from the preceding conduit element in the series where the first conduit element in the series is suspended from a point of anchorage located upstream; and disconnectable hooking means for hingedly connecting adjacent conduit elements, wherein the disconnectable hooking means of each conduit element comprises preformed protuberances on the upper and lower side of said element and is intended to cooperate with respective upper and lower protuberances of two adjacent conduit elements in order to form a hook arrangement which serves as a hinge.

6. System according to claim 5 wherein each conduit element and its respective disconnectable hooking means are formed together and are of unitary construction.

7. System according to claim 5, wherein said conduit elements are formed by molding.

8. System permitting the channeling of drainage fluid from a point located upstream to a point downstream comprising:

a plurality of conduit elements linked together in series to articulate with one another, each conduit element of the linked series being suspended from the preceding conduit element in the series where the first conduit element of the linked series is suspended from a point of anchorage located upstream;

disconnectable hooking means for hingedly connecting adjacent conduit elements so that the connected adjacent conduit elements are partially fitted into one another; and means, formed on said conduit elements, for ascent and descent of maintenance personnel on the system comprising rungs disposed on the conduit elements, said rungs projecting from at least one of the group consisting of the interior and exterior of said conduit elements.

9. A conduit element for use in a system for channeling drainage fluid, comprising: a bottom portion having an upper end, a lower end and two opposing surfaces;

two longitudinal sides extending, upwardly and outwardly, from the bottom portion, said bottom portion and longitudinal sides defining an open trough; and disconnectable hooking means for hingedly connecting adjacent conduit elements so that the connected adjacent conduit elements are partially fitted into one another to form a system for channeling drainage fluid, wherein the disconnectable hook means comprises a first hooking device disposed on one surface and the upper end of the bottom portion and a second hoking device disposed on the other opposing surface and the lower end of the bottom portion, sid first hooking device being adapted to engage the second hooking device of an upper adjacent conduit element and said second hooking device being adapted to engage the first hooking device of a lower conduit element in order to form a hook arrangement which serves as a hinged connecting adjacent conduit elements.

10. A conduit element according to claim 9, further comprising means, formed on one of the walls defining the open trough of the conduit element, for permitting maintenance personnel to ascend and descend along the system.

11. A conduit element according to claim 10, wherein said means for the ascent and descent of maintenance personnel comprises rungs disposed on the conduit elements, said rungs projecting from at least one of the group consisting of the interior and exterior of said conduit elements.

* * * * *